United States Patent [19]

Kaplinsky

[11] Patent Number: 4,959,667

[45] Date of Patent: Sep. 25, 1990

[54] REFILLABLE INK BAG

[75] Inventor: George Kaplinsky, San Diego, Calif.

[73] Assignee: Hewlett-Packard Company, Palo Alto, Calif.

[21] Appl. No.: 311,505

[22] Filed: Feb. 14, 1989

[51] Int. Cl.[5] ..... B41J 2/175; B41J 2/05

[52] U.S. Cl. ..... 346/140 R; 137/625.47

[58] Field of Search ..... 346/140; 137/625.22, 137/625.47

[56] References Cited

U.S. PATENT DOCUMENTS

| | | | |
|---|---|---|---|
| 3,708,798 | 1/1973 | Hildenbrand | 346/140 |
| 3,747,120 | 7/1973 | Stemme | 346/140 X |
| 4,320,406 | 3/1982 | Heinzl | 346/140 |
| 4,419,678 | 12/1983 | Kasugayama | 346/140 |
| 4,714,937 | 12/1987 | Kaplinsky | 346/140 |
| 4,723,129 | 2/1988 | Endo | 346/140 X |

*Primary Examiner*—Joseph W. Hartary

*Attorney, Agent, or Firm*—Edward Maker, II; Roland I. Griffin

[57] ABSTRACT

An ink delivery system (1) for delivering ink to a print head comprising an ink supply bag (3), an ink regulating bag (5), a three way valve (7), a print head (19), pipes (11, 13, 15) to transfer selectively ink from the supply bag to the regulating bag or from the regulating bag to the print head. The regulating bag is at a lower level than the print head.

7 Claims, 2 Drawing Sheets

REFILLABLE INK BAG

CROSS-REFERENCE TO RELATED PATENT

This invention is an improvement on the ink delivery system described and claimed in U. S. Pat. No. 4,714,937, entitled Ink Delivery System, inventor George T. Kaplinsky, the inventor herein.

CROSS-REFERENCE TO RELATED CO-PENDING APPLICATION

This invention is an improvement on the ink delivery system described and claimed in co-pending application Ser. No. 07/311,017, filed Feb. 14, 1989, Ross R. Allen and George Kaplinsky, inventors now U.S. Pat. No. 4,885,595.

TECHNICAL FIELD

This invention relates to ink-jet printers. Specifically, it is directed to a system in which a collapsible ink regulating bag is located below the print head, thus delivering the ink to the head at a certain negative pressure.

BACKGROUND ART

U.S. Pat. No. 4,714,937 and U.S. patent application Ser. No. 07/311,017, filed Feb. 14, 1989 now U.S. Pat. No. 4,885,595 are directed to systems in which the printing head or cartridge prints on a vertically disposed media. Also, the ink regulating bag receives its ink supply from the ink supply bag through underlying channels and dispenses the ink to the printing head through underlying channels. In addition, when the printing head is new, a dimpler system in the product is used to start the flow of ink from the ink regulating bag to the print head. This system provides means for printing with multiple colors, whereas the structure described herein show a single color arrangement.

U.S. Pat. No. 4,320,406, which issued on Mar. 16, 1982 to Joachim Heinzl, describes a system in which the printing head is disposed to print on a vertically disposed media. The ink is supplied from a cup or pot through a needle which penetrates the bottom of the cup or pot when it is forced into position. The ink then travels through supply lines to the printer. This system does not have a separate ink supply bag, a separate ink regulating bag or a three-way valve, which are present in the presently claimed system.

DISCLOSURE OF INVENTION

It is an advantage of the present invention to provide an ink-jet delivery system that is capable of printing on a vertically disposed media.

It is another advantage of this invention to provide a low cost system that reliably and repeatedly delivers a minimum of 6 ml. of ink from an ink supply bag to the ink regulating bag.

It is another advantage to provide a system wherein the ink does not come in contact with air.

It is still another advantage of the invention to provide a system that can run unattended for several hours, e.g., overnight.

Yet another advantage is to provide ink to the print head at a certain negative pressure.

In accordance with the invention, an ink delivery system for a printer comprises:

(a) an ink supply bag;

(b) an ink regulating bag;

(c) a print head;

(d) a three way valve;

(e) means for supplying ink from the ink supply bag to the ink regulating bag through the three way valve;

(f) means for supplying ink from the ink regulating bag to a print head through the three way valve;

(g) means for selectively shutting off the flow of ink from the ink supply bag to the ink regulating bag or from the ink regulating bag to the print head or both;

the ink regulating bag being positioned at a level lower than the print head.

BEST MODES FOR CARRYING OUT THE INVENTION

Figure 1:
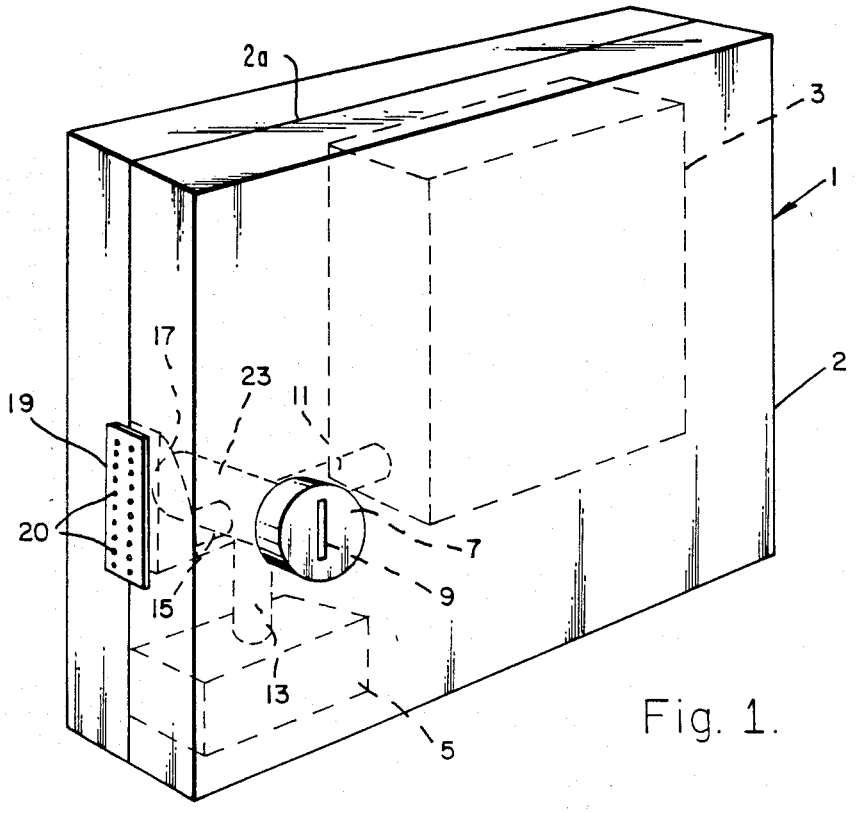
FIG. 1 is a perspective view of an ink delivery system of the present invention, partially in phantom.
Figure 2:
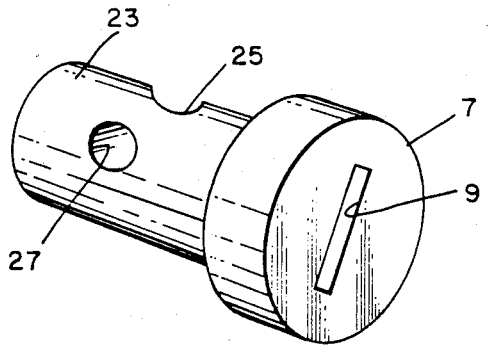
FIG. 2 is a perspective view of a valve which may be used in the present invention.
Figure 3:
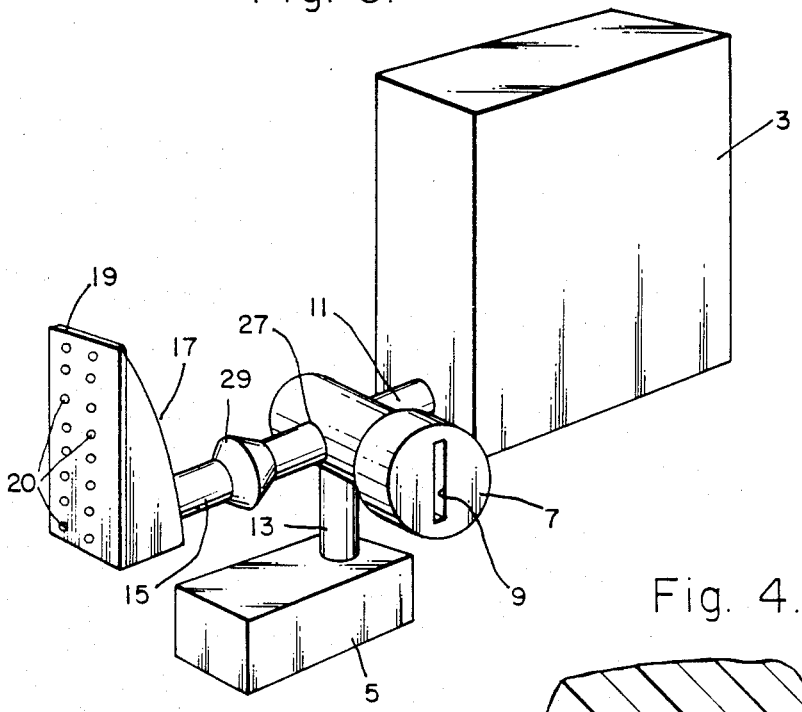
FIG. 3 is a perspective view of an ink delivery system of the present invention without its supporting case.

Referring to the drawings, wherein like numerals of reference designate like elements throughout, a system for delivering ink to a print head is shown generally at 1. It comprises a container 2, which is capable of supporting as well as enclosing the other elements of the system, an ink supply bag 3, an ink regulating bag 5, and a 3-way valve 7, ink delivery pipes 11, 13 and 15 and print head 19. Container 2 may be two mating pieces of polystyrene which abut along the line 2*a* and which have mating voids to receive and support the other elements.

Figure 4:
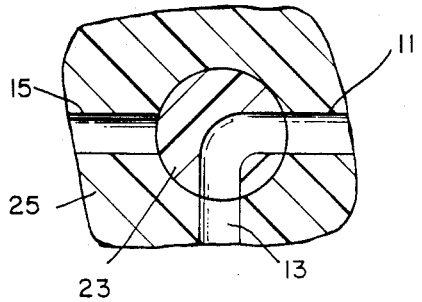
FIG. 4 is a side view in cross-section of the valve illustrating one mode to refill the ink supply bag.

Ink supply bag 3 is capable of holding enough ink to provide a pre-determined number of refills to ink regulating bag 5. A volume from about 100 ml. to 400 ml., preferably about 200 ml., is recommended. With valve 7 in the refill mode, as illustrated in FIG. 4, ink flows from bag 3 through pipe 11, valve 7 and pipe 13 to regulating bag 5, which is designed to contain from about 4 ml. to about 10 ml., preferably 6 ml. of ink. It is possible to print 150 pages of text or complete without interruption a 50% density E-size plot. Regulating bag 5 is collapsible and may assume a substantially rectangular shape when filled.

Figure 5:
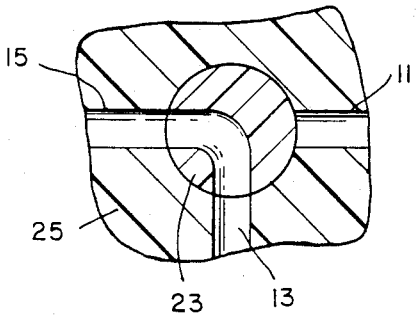
FIG. 5 is a side view in cross-section of the valve illustrating the printing mode.
Figure 6:
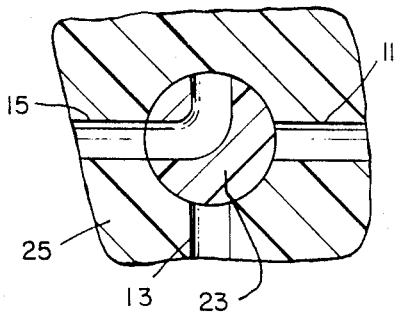
FIG. 6 is a side view in cross-section of the valve illustrating the off mode.

When regulating bag 5 is filled, 3-way valve 7 is rotated to the off mode, as illustrated in FIG. 6 or to the print mode, as illustrated in FIG. 5. This can be done manually, for instance, by inserting a key into slot 9 and turning valve 7, including stem 23, so that openings 25 and 27 in stem 23 are appropriately aligned with respect to pipes 11, 13, and 15. Valve 23 can also be rotated automatically by using a keyed feature on valve 7 to rotate it to the required positions. When valve 7 is in the print mode, as in FIG. 5, ink flows through pipe 13, valve 7 and pipe 15 to print head 19, which may be a thermal ink-jet pen. Head 19 includes ink feed channel 17 and ports 21. In a preferred embodiment, pipe 15 will include filter 29.

In operation, it is important to deliver ink to print head 19 at a negative pressure. This is accomplished by locating ink regulating bag 5 lower than print head 19 and using gravity to provide the negative pressure.

The present system is economical and is capable of delivering more than 90% of the ink that is in ink supply bag 3. It can reliably refill ink regulating bag 5 from supply bag 3 until bag 3 is substantially empty. Because the system is closed, it prevents evaporation; this is especially important when dealing with inks which are extremely high in water content and tend to evaporate fast. The print head can be primed and repaired without worrying about air bubbles since the system is free of air. It is a self-contained and integral unit; shipping issues, such as altitude, temperature, shelf life, air and water permeability no longer present problems. In addition, it can be readily modified to a tricolor system, such as described in the co-pending application Ser. No. 311,017. It is not necessary to dimple the present system.

INDUSTRIAL APPLICABILITY

The ink delivery system disclosed herein is expected to find use in ink-jet printers.

Various changes and modifications in the present system will be apparent to those of ordinary skill in the art. All such changes and modifications fall within the scope of the invention, as defined by the appended claims.

What is claimed is:

1. An ink delivery system (1) for a printer comprising:

(a) an ink supply bag(3);

(b) an ink regulating bag (5);

(c) a print head (19);

(d) a three way valve (7) comprising a rotatable stem having an angled channel therein;

(e) means (11,13) for supplying ink from said ink supply bag to said ink regulating bag through said angled channel in said three way valve;

(f) means (13, 15) for supplying ink from said ink regulating bag to a print head through said angled channel in said three way valve;

(g) means (7) for selectively rotating said stem to shut off the flow of ink from the ink supply to the ink regulating bag of from the ink regulating bag to the print head for both;

the ink regulating bag being positioned at a level lower than the print head.

2. The ink delivery system of claim 1 wherein the system is thermal ink-jet system.

3. The ink delivery system of claim 2 wherein the ink supply bag is collapsible.

4. The ink delivery system of claim 2 wherein the ink regulating bag is collapsible.

5. The ink delivery system of claim 2 wherein the system is enclosed in a supporting case (2).

6. The ink delivery system of claim 2 wherein the ink is delivered to the print head at a negative pressure provided by gravity.

7. An ink delivery system (1) for a printer comprising:

(a) an ink supply bag (3);

(b) an ink regulating bag (5);

(c) a print head (19);

(d) a three way valve (7) comprising a rotatable stem having a substantially right angle channel therein;

(e) means (11, 13) for supplying ink from said ink supply bag to said ink regulating bag through said substantially right angle channel in said three way wave;

(f) means (13, 15) for supplying ink from said ink regulating bag to a print head through said substantially right angle channel in said three way valve;

(g) means (7) for selectively rotating said stem to shut off the flow of ink from the ink supply to the ink regulating bag or from the ink regulating bag to the print head or both;

the ink regulating bag being positioned at a level lower than the print head.

* * * * *